US010316776B2

(12) United States Patent
Kobayashi et al.

(10) Patent No.: US 10,316,776 B2
(45) Date of Patent: Jun. 11, 2019

(54) CONTROL APPARATUS FOR AN INTERNAL COMBUSTION ENGINE

(71) Applicant: Toyota Jidosha Kabushiki Kaisha, Toyota-shi Aichi-ken (JP)

(72) Inventors: Hiroshi Kobayashi, Susono (JP); Kazuhiro Umemoto, Ebina (JP); Toshihiro Mori, Gotenba (JP); Shigeki Nakayama, Gotenba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 254 days.

(21) Appl. No.: 15/151,134

(22) Filed: May 10, 2016

(65) Prior Publication Data

US 2016/0333808 A1 Nov. 17, 2016

(30) Foreign Application Priority Data

May 11, 2015 (JP) ..... 2015-096560

(51) Int. Cl.
*F02D 41/02* (2006.01)
*F01N 3/20* (2006.01)
(Continued)

(52) U.S. Cl.
CPC ..... *F02D 41/0275* (2013.01); *F01N 3/0814* (2013.01); *F01N 3/0842* (2013.01);
(Continued)

(58) Field of Classification Search
CPC .... F01N 3/0814; F01N 3/0842; F01N 3/0885; F01N 3/2066; F02D 41/0275; F02D 2200/0806
See application file for complete search history.

(56) References Cited

U.S. PATENT DOCUMENTS 6,047,542 A * 4/2000 Kinugasa ..... B01D 53/8696 123/443
6,109,024 A * 8/2000 Kinugasa ..... F01N 3/0842 60/285
(Continued)

FOREIGN PATENT DOCUMENTS

EP 0903477 A2 3/1999
FR 2772428 A1 6/1999
(Continued)

*Primary Examiner* — Patrick D Maines
(74) *Attorney, Agent, or Firm* — Dinsmore & Shohl LLP

(57) ABSTRACT

A control apparatus for an internal combustion engine having an exhaust gas purification device which is arranged in an exhaust passage and includes a NOx storage reduction (NSR) catalyst. The control apparatus, when the air fuel ratio of the air-fuel mixture is shifted from a lean air fuel ratio to the stoichiometric air fuel ratio, determines a predetermined $NO_x$ amount so as to be larger when the temperature detected by the first detection unit is high in comparison with when the detected temperature is low, and when the storage amount of $NO_x$ in the NSR catalyst is larger than the predetermined $NO_x$ amount, performs the rich spike processing and then controls the air fuel ratio to the stoichiometric air fuel ratio, whereas when otherwise, controls the air fuel ratio to the stoichiometric air fuel ratio without performing the rich spike processing.

3 Claims, 8 Drawing Sheets

(51) Int. Cl.
*F01N 3/08* (2006.01)
*F02D 41/14* (2006.01)
*F02D 41/30* (2006.01)

(52) U.S. Cl.
CPC ..... *F01N 3/0885* (2013.01); *F01N 3/2066* (2013.01); *F02D 41/1446* (2013.01); *F02D 41/1454* (2013.01); *F02D 41/1463* (2013.01); *F02D 41/1479* (2013.01); *F02D 41/3064* (2013.01); *F01N 2570/14* (2013.01); *F02D 41/1461* (2013.01); *F02D 41/1475* (2013.01); *F02D 41/1487* (2013.01); *F02D 2200/0802* (2013.01); *F02D 2200/0806* (2013.01); *F02D 2200/0808* (2013.01); *F02D 2250/36* (2013.01)

(56) References Cited

U.S. PATENT DOCUMENTS 6,345,496 B1 * 2/2002 Fuwa ..... B01D 53/8696 60/274
6,732,507 B1 * 5/2004 Stanglmaier ..... F01N 3/035 60/280
6,823,843 B1 * 11/2004 Goralski, Jr. ..... F02D 41/0275 123/435
7,000,385 B2 * 2/2006 Miyashita ..... F01N 3/0842 60/274
9,702,310 B2 * 7/2017 Kim ..... F02D 41/0235
2006/0010857 A1 * 1/2006 Hu ..... B01D 53/9481 60/286
2007/0175208 A1 * 8/2007 Bandl-Konrad ... B01D 53/9431 60/286
2008/0006025 A1 * 1/2008 McCarthy ..... F01N 3/0253 60/286
2010/0071347 A1 * 3/2010 Yoshida ..... B01D 53/9418 60/276
2011/0214417 A1 9/2011 Sakurai et al.
2011/0252766 A1 * 10/2011 Ramanathan ..... F01N 3/0814 60/274

FOREIGN PATENT DOCUMENTS

JP 2000-064877 A 2/2000
WO 2005035952 A1 4/2005

* cited by examiner

CONTROL APPARATUS FOR AN INTERNAL COMBUSTION ENGINE

CROSS-REFERENCE TO RELATED APPLICATIONS

This application claims the benefit of priority to Japanese Patent Application No. 2015-096560 filed May 11, 2015, which is hereby incorporated by reference in its entirety.

TECHNICAL FIELD

The present disclosure relates to a control apparatus which is applied to an internal combustion engine with an exhaust gas purification device including a $NO_x$ storage reduction catalyst (NSR ($NO_x$ Storage Reduction) catalyst) arranged in an exhaust passage.

BACKGROUND ART

As an internal combustion engine in which the air fuel ratio of an air-fuel mixture can be changed, there has been known one in which an exhaust gas purification device including an NSR catalyst is arranged in an exhaust passage. In such an internal combustion engine, there has been proposed a technology in which at the time when an amount of $NO_x$ stored in the NSR catalyst (a storage amount of $NO_x$) becomes equal to or more than a predetermined threshold value when the air fuel ratio of the air-fuel mixture is a lean air fuel ratio which is an air fuel ratio higher than a stoichiometric air fuel ratio, the air fuel ratio of exhaust gas flowing into the NSR catalyst is controlled from the stoichiometric air fuel ratio to a rich air fuel ratio (rich spike processing), so that the $NO_x$ stored in the NSR catalyst is reduced and purified (removed). In addition, there has also been proposed a technology in which when the storage amount of $NO_x$ in the NSR catalyst is more than a predetermined amount which is smaller than the above-mentioned predetermined threshold value at the time when the air fuel ratio of the air-fuel mixture is changed from a lean air fuel ratio to the stoichiometric air fuel ratio, rich spike processing is carried out (for example, see Patent Literature 1).

CITATION LIST

Patent Literature

Patent Literature 1 Japanese patent laid-open publication No. 2000-064877

SUMMARY

Technical Problem

However, according to the technology described in the above-mentioned Patent Literature 1, when the air fuel ratio of the air-fuel mixture is changed from the lean air fuel ratio to the stoichiometric air fuel ratio, rich spike processing may be carried out unnecessarily, in spite of the fact that there is room or margin for the $NO_x$ storage ability of the NSR catalyst. For that reason, an increase in the amount of fuel consumption resulting from the unnecessary execution of the rich spike processing may be caused.

The present disclosure has been made in view of the above-mentioned actual circumstances, and the object of the present disclosure is to provide a technology in which when the air fuel ratio of an air-fuel mixture is shifted from a lean air fuel ratio to a stoichiometric air fuel ratio, the amount of $NO_x$ discharged from an NSR catalyst can be suppressed small, while suppressing an increase in the amount of fuel consumption resulting from the execution of rich spike processing to a small level.

Solution to Problem

In order to solve the above-mentioned problems, the present disclosure is directed to a control apparatus applied to an internal combustion engine having an exhaust gas purification device which is arranged in an exhaust passage and includes a $NO_x$ storage reduction catalyst (an NSR catalyst), wherein at the time of the air fuel ratio of the air-fuel mixture being shifted from a lean air fuel ratio to a stoichiometric air fuel ratio, rich spike processing is carried out when there is no room or margin in the $NO_x$ storage ability of the NSR catalyst, and on the other hand, rich spike processing is not carried out when there is room or margin for the $NO_x$ storage ability of the NSR catalyst.

In some embodiments, the present disclosure is directed to a control apparatus for an internal combustion engine, the internal combustion engine having an exhaust gas purification device which is arranged in an exhaust passage and includes a $NO_x$ storage reduction (NSR) catalyst, the control apparatus comprising; a first detection unit configured to detect a temperature of the NSR catalyst; a second detection unit configured to a $NO_x$ storage amount which is an amount of $NO_x$ stored in the NSR catalyst; a rich spike unit configured to carry out rich spike processing which is to reduce $NO_x$ stored in the NSR catalyst by adjusting an air fuel ratio of exhaust gas flowing into the exhaust gas purification device to a rich air fuel ratio; and a control unit configured, when the air fuel ratio of the air-fuel mixture is shifted from a lean air fuel ratio to the stoichiometric air fuel ratio, to control the rich spike unit in such a manner that the rich spike processing is carried out in a state in which the storage amount of $NO_x$ detected by the second detection unit is smaller when the temperature detected by the first detection unit is high in comparison with when the temperature is low, and further control the air fuel ratio of the air-fuel mixture to the stoichiometric air fuel ratio after the end of the rich spike processing.

A maximum value of the amount of $NO_x$ which can be stored by the NSR catalyst, in other words, a storage amount of $NO_x$ ($NO_x$ storage capacity) at the time when the $NO_x$ storage ability of the NSR catalyst is saturated, is smaller in the case where the air fuel ratio of exhaust gas flowing into the exhaust gas purification device is the stoichiometric air fuel ratio than in the case where it is the lean air fuel ratio. For that reason, when the air fuel ratio of exhaust gas flowing into the exhaust gas purification device is shifted from the lean air fuel ratio to the stoichiometric air fuel ratio according to the shifting of the air fuel ratio of the air-fuel mixture from the lean air fuel ratio to the stoichiometric air fuel ratio, the $NO_x$ storage capacity of the NSR catalyst decreases. Accordingly, when the storage amount of $NO_x$ in the NSR catalyst immediately before the air fuel ratio of the air-fuel mixture is shifted from the lean air fuel ratio to the stoichiometric air fuel ratio exceeds the $NO_x$ storage capacity of the NSR catalyst after the air fuel ratio of the air-fuel mixture has been shifted from the lean air fuel ratio to the stoichiometric air fuel ratio, $NO_x$ will be discharged from the NSR catalyst.

However, the $NO_x$ storage capacity of the NSR catalyst changes not only with the air fuel ratio of exhaust gas flowing into the exhaust gas purification device but with the temperature of the NSR catalyst. That is, when the temperature of the NSR catalyst is high, the $NO_x$ storage capacity of the NSR catalyst becomes smaller, in comparison with when it is low. In view of such a characteristic of the NSR catalyst, when the temperature of the NSR catalyst is relatively high at the time of the shifting of the air fuel ratio of the air-fuel mixture from the lean air fuel ratio to the stoichiometric air fuel ratio, an amount of margin of the $NO_x$ storage ability after the air fuel ratio of the air-fuel mixture has been shifted from the lean air fuel ratio to the stoichiometric air fuel ratio becomes small. For that reason, when the temperature of the NSR catalyst is relatively high at the time of the shifting of the air fuel ratio of the air-fuel mixture from the lean air fuel ratio to the stoichiometric air fuel ratio, $NO_x$ tends to be easily discharged from the NSR catalyst after the air fuel ratio of the air-fuel mixture has been shifted from the lean air fuel ratio to the stoichiometric air fuel ratio, even if the storage amount of $NO_x$ in the NSR catalyst is in a relatively small state. On the other hand, when the temperature of the NSR catalyst is relatively low at the time of the shifting of the air fuel ratio of the air-fuel mixture from the lean air fuel ratio to the stoichiometric air fuel ratio, the amount of margin of the $NO_x$ storage ability after the air fuel ratio of the air-fuel mixture has been shifted from the lean air fuel ratio to the stoichiometric air fuel ratio tends to become large. For that reason, when the temperature of the NSR catalyst is relatively low at the time of the shifting of the air fuel ratio of the air-fuel mixture from the lean air fuel ratio to the stoichiometric air fuel ratio, $NO_x$ tends to be hardly discharged from the NSR catalyst after the air fuel ratio of the air-fuel mixture has been shifted from the lean air fuel ratio to the stoichiometric air fuel ratio, even if the storage amount of $NO_x$ in the NSR catalyst is in a relatively large state.

In contrast to this, according to the control apparatus for an internal combustion engine according to the present disclosure, when the temperature of the NSR catalyst is high at the time of the shifting of the air fuel ratio of the air-fuel mixture from the lean air fuel ratio to the stoichiometric air fuel ratio, the rich spike processing will be carried out in a state in which the storage amount of $NO_x$ detected by the second detection unit is smaller when the temperature detected by the first detection unit is high in comparison with when the temperature is low, and the air fuel ratio of the air-fuel mixture will be shifted to the stoichiometric air fuel ratio after the end of the rich spike processing, without being returned to the lean air fuel ratio. As a result, when the temperature of the NSR catalyst is relatively high at the time of the shifting of the air fuel ratio of the air-fuel mixture from the lean air fuel ratio to the stoichiometric air fuel ratio (i.e., when the amount of margin of the $NO_x$ storage ability is small), the rich spike processing will be carried out even in a state in which the storage amount of $NO_x$ in the NSR catalyst is relatively small, and the air fuel ratio of the air-fuel mixture will be shifted to the stoichiometric air fuel ratio after the execution of the rich spike processing, without being returned to the lean air fuel ratio. On the other hand, when the temperature of the NSR catalyst is relatively low at the time of the shifting of the air fuel ratio of the air-fuel mixture from the lean air fuel ratio to the stoichiometric air fuel ratio (i.e., when the amount of margin of the $NO_x$ storage ability is large), even if the storage amount of $NO_x$ in the NSR catalyst is in a relatively large state, the air fuel ratio of the air-fuel mixture will be shifted to the stoichiometric air fuel ratio, without the rich spike processing being carried out. Accordingly, when the air fuel ratio of the air-fuel mixture is shifted from the lean air fuel ratio to the stoichiometric air fuel ratio, the amount of $NO_x$ discharged from the NSR catalyst after the air fuel ratio of the air-fuel mixture has been shifted from the lean air fuel ratio to the stoichiometric air fuel ratio can be suppressed to a small level, while suppressing unnecessary execution of the rich spike processing. In addition, according to the control apparatus for an internal combustion engine of the present disclosure, the opportunity for the rich spike processing to be carried out in the state where the temperature of the NSR catalyst is relatively low can be decreased. Here, when the temperature of the NSR catalyst is relatively low, the $NO_x$ removing or reducing ability of the NSR catalyst may become low. For that reason, when the rich spike processing is carried out in the state where the temperature of the NSR catalyst is relatively low, the amount of $NO_x$, which is not reduced in the NSR catalyst, may be increased. On the other hand, when the opportunity for the rich spike processing to be carried out in the state where the temperature of the NSR catalyst is relatively low becomes smaller, the opportunity for the amount of $NO_x$ not reduced in the NSR catalyst to increase can also be decreased.

The control unit of the present disclosure may control the rich spike unit, when the air fuel ratio of the air-fuel mixture is shifted from the lean air fuel ratio to the stoichiometric air fuel ratio, in such a manner that the rich spike processing is carried out when the storage amount of $NO_x$ detected by the second detection unit is larger than a predetermined $NO_x$ amount, and to change the predetermined $NO_x$ amount so as to be smaller when the temperature detected by the first detection unit is high in comparison with when the detected temperature is low.

According to such a construction, when the temperature of the NSR catalyst is high at the time of the shifting of the air fuel ratio of the air-fuel mixture from the lean air fuel ratio to the stoichiometric air fuel ratio, the predetermined $NO_x$ amount is made to be a smaller value, in comparison with when the temperature is low. For that reason, when the temperature of the NSR catalyst is relatively high at the time of the air fuel ratio of the air-fuel mixture being shifted from the lean air fuel ratio to the stoichiometric air fuel ratio, the storage amount of $NO_x$ becomes more than the predetermined $NO_x$ amount, even if the storage amount of $NO_x$ in the NSR catalyst is in a relatively small state. As a result, the air fuel ratio of the air-fuel mixture will be shifted to the stoichiometric air fuel ratio, after the rich spike processing has been carried out. On the other hand, when the temperature of the NSR catalyst is relatively low at the time of the air fuel ratio of the air-fuel mixture being shifted from the lean air fuel ratio to the stoichiometric air fuel ratio, the storage amount of $NO_x$ becomes equal to or less than the predetermined $NO_x$ amount, even if the storage amount of $NO_x$ in the NSR catalyst is in a relatively large state. As a result, the air fuel ratio of the air-fuel mixture will be shifted from the lean air fuel ratio to the stoichiometric air fuel ratio, without the rich spike processing being not carried out.

Here, note that the predetermined $NO_x$ amount may be changed according to the $NO_x$ storage capacity of the NSR catalyst after the air fuel ratio of the air-fuel mixture has been shifted from the lean air fuel ratio to the stoichiometric air fuel ratio. In that case, the control unit for an internal combustion engine of the present disclosure may be further provided with an estimation unit configured to estimate a $NO_x$ storage capacity which is an amount of $NO_x$ able to be stored by the $NO_x$ storage reduction catalyst after a shifting of the air fuel ratio of the air-fuel mixture from the lean air fuel ratio to the stoichiometric air fuel ratio, before the shifting, wherein the estimation unit estimates the $NO_x$ storage capacity to be small when the temperature detected by the first detection unit is high in comparison with when the temperature is low; wherein the control unit is configured, when the air fuel ratio of the air-fuel mixture is shifted from the lean air fuel ratio to the stoichiometric air fuel ratio, to control the rich spike unit in such a manner that the rich spike processing is carried out when the storage amount of $NO_x$ detected by the second detection unit is larger than a predetermined $NO_x$ amount, and to change the predetermined $NO_x$ amount so as to be smaller when the $NO_x$ storage capacity estimated by the estimation unit is small in comparison with when the $NO_x$ storage capacity is large.

According to such a construction, in cases where the storage amount of $NO_x$ before the air fuel ratio of the air-fuel mixture is shifted from the lean air fuel ratio to the stoichiometric air fuel ratio is larger than the $NO_x$ storage capacity after the shifting, the rich spike processing will be carried out in a more reliable manner. On the other hand, in cases where the storage amount of $NO_x$ before the air fuel ratio of the air-fuel mixture is shifted from the lean air fuel ratio to the stoichiometric air fuel ratio is equal to or less than the $NO_x$ storage capacity after the shifting, the rich spike processing will not be carried out in a more reliable manner. Accordingly, at the time when the air fuel ratio of the air-fuel mixture is shifted from the lean air fuel ratio to the stoichiometric air fuel ratio, unnecessary execution of the rich spike processing can be suppressed in a more reliable manner, and at the same time, the amount of $NO_x$ discharged from the NSR catalyst after the air fuel ratio of the air-fuel mixture has been shifted from the lean air fuel ratio to the stoichiometric air fuel ratio can be suppressed to be small in a more reliable manner.

Here, the $NO_x$ storage capacity of the NSR catalyst may also change with the concentration of $NO_x$ contained in the exhaust gas, in addition to the air fuel ratio of exhaust gas flowing into the exhaust gas purification device or the temperature of the NSR catalyst. For example, when the concentration of $NO_x$ in the exhaust gas flowing into the exhaust gas purification device is low, the $NO_x$ storage capacity of the NSR catalyst may become smaller, in comparison with when the concentration of $NO_x$ is high. Accordingly, the estimation unit may be configured to predict a concentration of $NO_x$ in the exhaust gas flowing into the exhaust gas purification device after the shifting, estimate the $NO_x$ storage capacity to be smaller when the $NO_x$ concentration is low in comparison with when the $NO_x$ concentration is high while estimating the $NO_x$ storage capacity to be smaller when the temperature detected by the first detection unit is high in comparison with when the detected temperature is low.

Next, the exhaust gas purification device may be equipped with an NSR catalyst and a selective catalytic reduction catalyst (SCR (Selective Catalytic Reduction) catalyst) that is arranged at the downstream side of the NSR catalyst. In the arrangement in which the SCR catalyst is arranged at the downstream side of the NSR catalyst, at least a part of $NO_x$ discharged from the NSR catalyst after the air fuel ratio of the air-fuel mixture has been shifted from the lean air fuel ratio to the stoichiometric air fuel ratio reacts with $NH_3$ adsorbed to the SCR catalyst, so that it is thereby reduced and removed. For that reason, incases where the amount of $NO_x$ discharged from the NSR catalyst after the air fuel ratio of the air-fuel mixture has been shifted from the lean air fuel ratio to the stoichiometric air fuel ratio is equal to or less than an amount of $NO_x$ (hereinafter, referred to as an "$NO_x$ reducible amount") which can be reduced or removed by $NH_3$ adsorbed to the SCR catalyst, even when the air fuel ratio of the air-fuel mixture is shifted from the lean air fuel ratio to the stoichiometric air fuel ratio in a state where the storage amount of $NO_x$ in the NSR catalyst is more than the predetermined $NO_x$ amount, the $NO_x$ discharged from the NSR catalyst after the shifting will be reduced and removed by the SCR catalyst. On the other hand, in the case where the amount of $NO_x$ discharged from the NSR catalyst after the air fuel ratio of the air-fuel mixture has been shifted from the lean air fuel ratio to the stoichiometric air fuel ratio is more than the $NO_x$ reducible amount, when the air fuel ratio of the air-fuel mixture is shifted from the lean air fuel ratio to the stoichiometric air fuel ratio in a state where the storage amount of $NO_x$ in the NSR catalyst is more than the predetermined $NO_x$ amount, a part of the $NO_x$ discharged from the NSR catalyst after the shifting will not be reduced and removed by the SCR catalyst, so that it will be discharged into the atmosphere.

Accordingly, in cases where the exhaust gas purification device is equipped with the NSR catalyst and the SCR catalyst, the control apparatus may be further provided with a third detection unit configured to detect an amount of $NH_3$ adsorption which is an amount of $NH_3$ adsorbed to the selective catalytic reduction catalyst. Then, the control unit may control the rich spike unit so that the rich spike processing is carried out when the storage amount of $NO_x$ detected by the second detection unit is more than the predetermined $NO_x$ amount and a difference between the storage amount of $NO_x$ detected by the second detection unit and the predetermined $NO_x$ amount is more than an amount of $NO_x$ which can be reduced by the amount of $NH_3$ adsorption detected by the third detection unit.

According to such a construction, even in the case where the storage amount of $NO_x$ in the NSR catalyst is more than the predetermined $NO_x$ amount, when the difference between the storage amount of $NO_x$ and the predetermined $NO_x$ amount is equal to or less than the $NO_x$ reducible amount in the SCR catalyst, the rich spike processing will not be carried out. For that reason, the opportunity for the rich spike processing to be carried out unnecessarily can be decreased in a more reliable manner. As a result, an increase in the amount of fuel consumption resulting from the unnecessary execution of the rich spike processing can be reduced in a more reliable manner.

Advantageous Effects of Invention

According to the present disclosure, when the air fuel ratio of an air-fuel mixture is shifted from a lean air fuel ratio to a stoichiometric air fuel ratio, the amount of $NO_x$ discharged from an NSR catalyst can be suppressed small, while suppressing an increase in the amount of fuel consumption resulting from the execution of rich spike processing to a small level.

Further features of the present disclosure will become apparent from the following description of exemplary embodiments with reference to the attached drawings.

DESCRIPTION OF EMBODIMENTS

Hereinafter, predetermined embodiments of the present disclosure will be described based on the attached drawings. However, the dimensions, materials, shapes, relative arrangements and so on of component parts described in the embodiments are not intended to limit the technical scope of the present disclosure to these alone in particular as long as there are no predetermined statements.

First Embodiment

Figure 1:
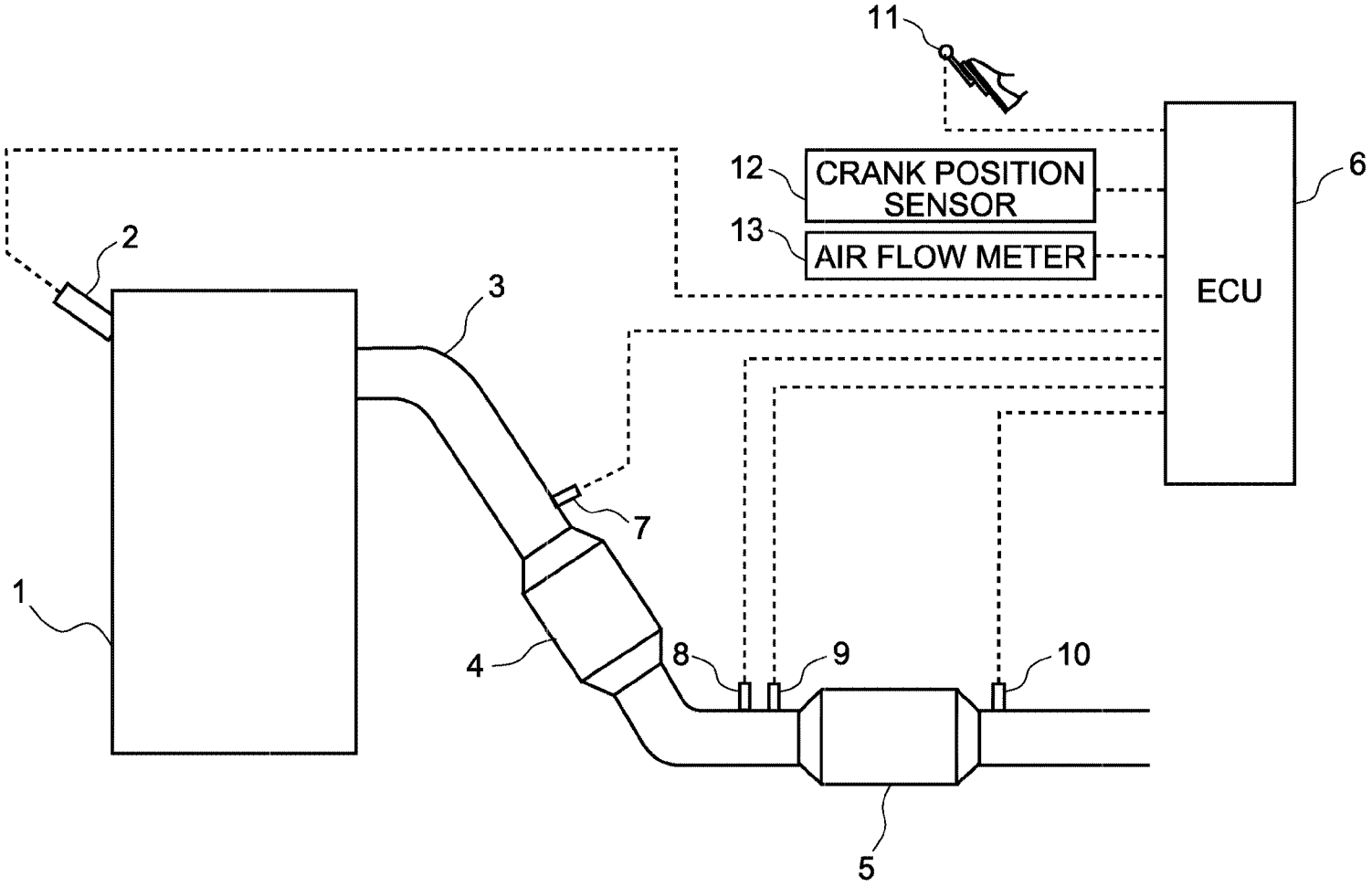
FIG. 1 is a view showing the schematic construction of an exhaust system of an internal combustion engine to which the present disclosure is applied, in a first embodiment of the present disclosure.

First, reference will be made to a first embodiment of the present disclosure based on FIGS. 1 through 6. FIG. 1 is a view showing the schematic construction of an internal combustion engine and its exhaust system, to which the present disclosure is applied. The internal combustion engine 1 shown in FIG. 1 is a spark ignition internal combustion engine in which the air fuel ratio of an air-fuel mixture can be changed. Here, note that the internal combustion engine 1 may be a compression ignition internal combustion engine.

The internal combustion engine 1 is provided with fuel injection valves 2 for supplying fuel to individual cylinders, respectively. Each of the fuel injection valves 2 may be a valve mechanism which serves to inject fuel into an intake port of each corresponding cylinder, or may be a valve mechanism which serves to inject fuel into each corresponding cylinder.

An exhaust pipe 3 is connected to the internal combustion engine 1. The exhaust pipe 3 is a pipe having a passage through which a gas (exhaust gas) combusted or burned in the interior of each cylinder of the internal combustion engine 1 flows. A first catalyst casing 4 is arranged in the middle of the exhaust pipe 3. The first catalyst casing 4 receives a three-way catalyst. Specifically, the first catalyst casing 4 receives a honeycomb structured body covered with a coat layer such as alumina, a precious metal (platinum (Pt), palladium (Pd), etc.) supported by the coat layer, and a promoter or co-catalyst such as ceria ($CeO_2$) supported by the coat layer.

A second catalyst casing 5 is arranged in the exhaust pipe 3 at the downstream side of the first catalyst casing 4. The second catalyst casing 5 receives an NSR catalyst that is equipped with a $NO_x$ occlusion or storage material. Specifically, the second catalyst casing 5 receives a honeycomb structured body covered with a coat layer such as alumina, a precious metal (platinum (Pt), palladium (Pd), etc.) supported by the coat layer, a promoter or co-catalyst such as ceria ($CeO_2$) supported by the coat layer, and a $NO_x$ occlusion or storage material (alkalines, alkaline earths, etc.) supported by the coat layer. The second catalyst casing 5 corresponds to an "exhaust gas purification device" according to the present disclosure.

In the internal combustion engine 1 constructed in this manner, there is arranged in combination therewith an ECU (Electronic Control Unit) 6 for controlling the internal combustion engine 1. The ECU 6 is an electronic control unit which is composed of a CPU, a ROM, a RAM, a backup RAM, and so on. The ECU 6 corresponds to a control apparatus according to the present disclosure. The ECU 6 is electrically connected to various kinds of sensors such as an air fuel ratio sensor (A/F sensor) 7, an oxygen concentration sensor (oxygen sensor) 8, a $NO_x$ sensor 9, an exhaust gas temperature sensor 10, an accelerator position sensor 11, a crank position sensor 12, an air flow meter 13, and so on.

The air fuel ratio sensor 7 is mounted on the exhaust pipe 3 at a location upstream of the first catalyst casing 4, and outputs an electric signal correlated with an air fuel ratio of the exhaust gas which flows into the first catalyst casing 4. The oxygen concentration sensor 8 is mounted on the exhaust pipe 3 at a location between the first catalyst casing 4 and the second catalyst casing 5, and outputs an electric signal correlated with a concentration of oxygen contained in the exhaust gas which flows out from the first catalyst casing 4. The $NO_x$ sensor 9 is mounted on the exhaust pipe 3 at a location between the first catalyst casing 4 and the second catalyst casing 5, and outputs an electric signal correlated with a concentration of $NO_x$ in the exhaust gas which flows into the second catalyst casing 5. The exhaust gas temperature sensor 10 is mounted on the exhaust pipe 3 at a location downstream of the second catalyst casing 5, and outputs an electric signal correlated with a temperature of the exhaust gas flowing in the interior of the exhaust pipe 3. The accelerator position sensor 11 is mounted on an accelerator pedal, and outputs an electric signal correlated with an amount of operation of the accelerator pedal (i.e., a degree of accelerator opening). The crank position sensor 12 is mounted on the internal combustion engine 1, and outputs an electric signal correlated with a rotational position of an engine output shaft (crankshaft). The air flow meter 13 is mounted on an intake pipe (not shown) of the internal combustion engine 1, and outputs an electric signal correlated with an amount (mass)) of fresh air (i.e., air) flowing in the intake pipe.

The ECU 6 controls the operating state of the internal combustion engine 1 based on the output signals of the above-mentioned variety of kinds of sensors. For example, the ECU 6 calculates a target air fuel ratio of the air-fuel mixture based on an engine load calculated from the output signal of the accelerator position sensor 11 (the accelerator opening degree) and an engine rotational speed calculated from the output signal of the crank position sensor 12. The ECU 6 calculates a target amount of fuel injection (a fuel injection period) based on the target air fuel ratio and the output signal of the air flow meter 13 (the amount of intake air), and controls the fuel injection valves 2 according to the target amount of fuel injection thus calculated.

Specifically, the ECU 6 sets the target air fuel ratio to a lean air fuel ratio which is higher than the stoichiometric air fuel ratio, in cases where the operating condition of the internal combustion engine 1, which is decided from the engine load and the engine rotational speed, belongs to a low rotation and low load region or in a middle rotation and middle load region (hereinafter, these operating regions are referred to as a lean operating region). In addition, the ECU 6 sets the target air fuel ratio to the stoichiometric air fuel ratio (or a rich air fuel ratio which is lower than the stoichiometric air fuel ratio), in cases where the operating condition of the internal combustion engine 1 belongs to a high load region or a high rotation region (hereinafter, these operating regions are referred to as a stoichiometric operating region). Thus, when the operating condition of the internal combustion engine 1 belongs to the lean operating region, the target air fuel ratio is set to a lean air fuel ratio, so that the internal combustion engine 1 is operated in a lean burn state, thereby making it possible to suppress the amount of fuel consumption to a low level.

In addition, the ECU 6 carries out rich spike processing in an appropriate manner, when the operating condition of the internal combustion engine 1 is in the above-mentioned lean operating region. The rich spike processing referred to herein is processing in which the exhaust gas flowing into the second catalyst casing 5 is made into a state where the concentration of oxygen is low and the concentration of hydrocarbon or carbon monoxide is high. That is, the rich spike processing is processing in which the air fuel ratio of the exhaust gas flowing into the second catalyst casing 5 is made to be a rich air fuel ratio lower than the stoichiometric air fuel ratio. The NSR catalyst received in the second catalyst casing 5 stores or adsorbs $NO_x$ in the exhaust gas, when the oxygen concentration of the exhaust gas flowing into the second catalyst casing 5 is high (i.e., when the air fuel ratio of the exhaust gas is a lean air fuel ratio). Moreover, the NSR catalyst releases the $NO_x$ stored in the NSR catalyst so as to reduce the $NO_x$ thus released to nitrogen ($N_2$) or ammonia ($NH_3$), when the oxygen concentration of the exhaust gas flowing into the second catalyst casing 5 is low, and when reducing components such as hydrocarbon (HC), carbon monoxide (CO), etc., are contained in the exhaust gas (i.e., when the air fuel ratio of the exhaust gas is a rich air fuel ratio).

Accordingly, the ECU 6 carries out rich spike processing, when the operating condition of the internal combustion engine 1 belongs to the lean operating region and when the storage amount of $NO_x$ in the NSR catalyst becomes more than a predetermined threshold value. The "predetermined threshold value" referred to herein is an amount which is obtained by subtracting a margin from a maximum value of the amount of $NO_x$ which is able to be occluded or stored by the NSR catalyst, in other words, a storage amount of $NO_x$ ($NO_x$ storage capacity) at the time when the $NO_x$ storage ability of the NSR catalyst is saturated. The storage amount of $NO_x$ in the NSR catalyst is obtained by a method of integrating an amount of $NO_x$ flowing into the first catalyst casing 4 per unit time from a point in time at which the last rich spike processing has ended. At that time, the amount of $NO_x$ flowing into the second catalyst casing 5 per unit time is assumed to be obtained by multiplying a measured value of the $NO_x$ sensor 9 ($NO_x$ concentration) and a flow rate of the exhaust gas (a total amount of a measured value of the air flow meter 13 (an amount of intake air) and an amount of fuel injection). Here, note that the amount of $NO_x$ flowing into the second catalyst casing 5 per unit time may be estimated by using the operating condition of the internal combustion engine 1 (the engine load, the engine rotation speed, etc.) as a parameter.

Here, note that as a predetermined method of carrying out the rich spike processing, there can be used a method of decreasing the air fuel ratio of the air-fuel mixture to a rich air fuel ratio lower than the stoichiometric air fuel ratio thereby to make the air fuel ratio of the exhaust gas flowing into the second catalyst casing 5 to be a rich air fuel ratio, by carrying out at least one of processing to increase the target amount of fuel injection for the fuel injection valves 2, and processing to decrease the opening degree of an intake air throttle valve (throttle valve). Here, note that in an arrangement in which each of the fuel injection valves 2 injects fuel directly into a corresponding cylinder, the rich spike processing may be carried out by a method of injecting fuel from each fuel injection valve 2 in the exhaust stroke of the corresponding cylinder.

As described above, when the rich spike processing is carried out in an appropriate manner at the time when the operating condition of the internal combustion engine 1 belongs to the lean operating region, the amount of $NO_x$ discharged into the atmosphere can be decreased, while suppressing the $NO_x$ storage ability of the NSR catalyst from being saturated. Here, note that the rich spike processing may be carried out, when the operating period of time of the internal combustion engine 1 from the last end time of the rich spike processing (in some embodiments, the operating period of time in which the target air fuel ratio has been set to a lean air fuel ratio) becomes equal to or more than a fixed period of time, or when the travel distance of a vehicle, on which the internal combustion engine 1 is mounted, from the last end time of the rich spike processing (in some embodiments, the travel distance within which the target air fuel ratio has been set to the lean air fuel ratio) becomes equal to or more than a fixed distance.

However, when the lean burn operation of the internal combustion engine 1 is carried out in a state where the $NO_x$ storage ability of the NSR catalyst has not been activated, $NO_x$ discharged from the internal combustion engine 1 may not be stored in the NSR catalyst. For that reason, the lean burn operation of the internal combustion engine 1 is assumed to be carried out on the condition that the $NO_x$ storage ability of the NSR catalyst has been activated.

Figure 2:
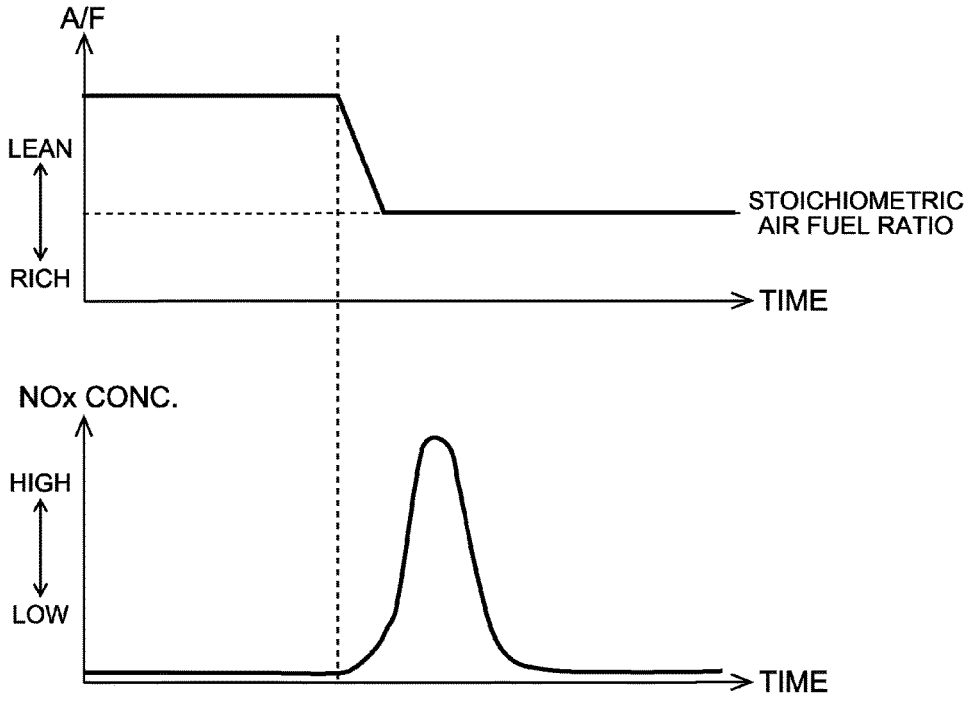
FIG. 2 is a timing chart showing the change over time of the $NO_x$ concentration of exhaust gas flowing out from a second catalyst casing, in cases where rich spike processing is not carried out at the time when the air fuel ratio (A/F) of an air-fuel mixture is shifted from a lean air fuel ratio to a stoichiometric air fuel ratio.

Moreover, the $NO_x$ storage capacity of the NSR catalyst changes according to the air fuel ratio of the exhaust gas flowing into the second catalyst casing 5. That is, the $NO_x$ storage capacity of the NSR catalyst becomes smaller in the case where the air fuel ratio of the exhaust gas flowing into the second catalyst casing 5 is low than in the case where it is high. For that reason, in cases where the operating condition of the internal combustion engine 1 is shifted from the lean operating region to the stoichiometric operating region, when the air fuel ratio of the air-fuel mixture is shifted from a lean air fuel ratio to the stoichiometric air fuel ratio, the air fuel ratio of the exhaust gas accordingly changes from a lean air fuel ratio to the stoichiometric air fuel ratio, so that the $NO_x$ storage capacity of the NSR catalyst may become smaller. Then, even in cases where the $NO_x$ storage capacity of the NSR catalyst before the shifting is larger than the storage amount of $NO_x$ therein, the $NO_x$ storage capacity after the shifting may become smaller than the storage amount of $NO_x$. When such a situation occurs, a part of the $NO_x$ stored in the NSR catalyst is discharged from the NSR catalyst, immediately after the air fuel ratio of the air-fuel mixture has been shifted from the lean air fuel ratio to the stoichiometric air fuel ratio. As a result, immediately after the air fuel ratio (A/F) of the air-fuel mixture has been shifted from the lean air fuel ratio to the stoichiometric air fuel ratio, the $NO_x$ concentration of the exhaust gas discharged from the first catalyst casing 4 increases, as shown in FIG. 2. Thus, when the $NO_x$ discharged from the NSR catalyst is discharged into the atmosphere, the deterioration of exhaust emissions will be caused.

Figure 3:
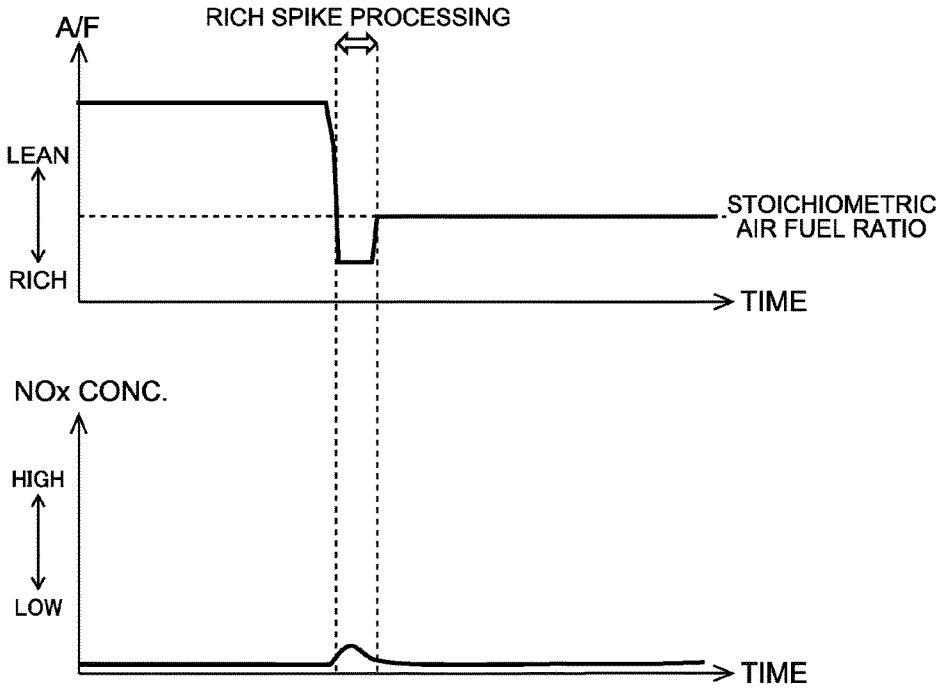
FIG. 3 is a timing chart showing the change over time of the $NO_x$ concentration of exhaust gas flowing out from the second catalyst casing, in cases where rich spike processing is carried out at the time when the air fuel ratio (A/F) of the air-fuel mixture is shifted from the lean air fuel ratio to the stoichiometric air fuel ratio.

With respect to the problem as mentioned above, there can be considered a method in which when the storage amount of $NO_x$ in the NSR catalyst is more than a predetermined $NO_x$ amount, at the time of the air fuel ratio of the air-fuel mixture being shifted from the lean air fuel ratio to the stoichiometric air fuel ratio, rich spike processing is carried out before the air fuel ratio of the air-fuel mixture is changed from the lean air fuel ratio to the stoichiometric air fuel ratio, and the air fuel ratio of the air-fuel mixture is controlled to the stoichiometric air fuel ratio, without being returned to the lean air fuel ratio after the end of the rich spike processing, whereby the amount of $NO_x$ discharged from the NSR catalyst is suppressed to a small level. When rich spike processing is carried out before the air fuel ratio of the air-fuel mixture is shifted from the lean air fuel ratio to the stoichiometric air fuel ratio, as shown in FIG. 3, a very small amount of $NO_x$ may be discharged from the NSR catalyst in the process in which the air fuel ratio of the exhaust gas shifts from the lean air fuel ratio to a rich air fuel ratio, but the amount of $NO_x$ discharged from the NSR catalyst immediately after the air fuel ratio of the air-fuel mixture has been shifted to the stoichiometric air fuel ratio can be suppressed to be small. Accordingly, in the case where rich spike processing is carried out in the process in which the air fuel ratio of the air-fuel mixture is shifted from the lean air fuel ratio to the stoichiometric air fuel ratio, the amount of $NO_x$ discharged from the NSR catalyst immediately after the air fuel ratio of the air-fuel mixture has been shifted to the stoichiometric air fuel ratio can be suppressed to be smaller than in the case where rich spike processing is not carried out.

Figure 4:
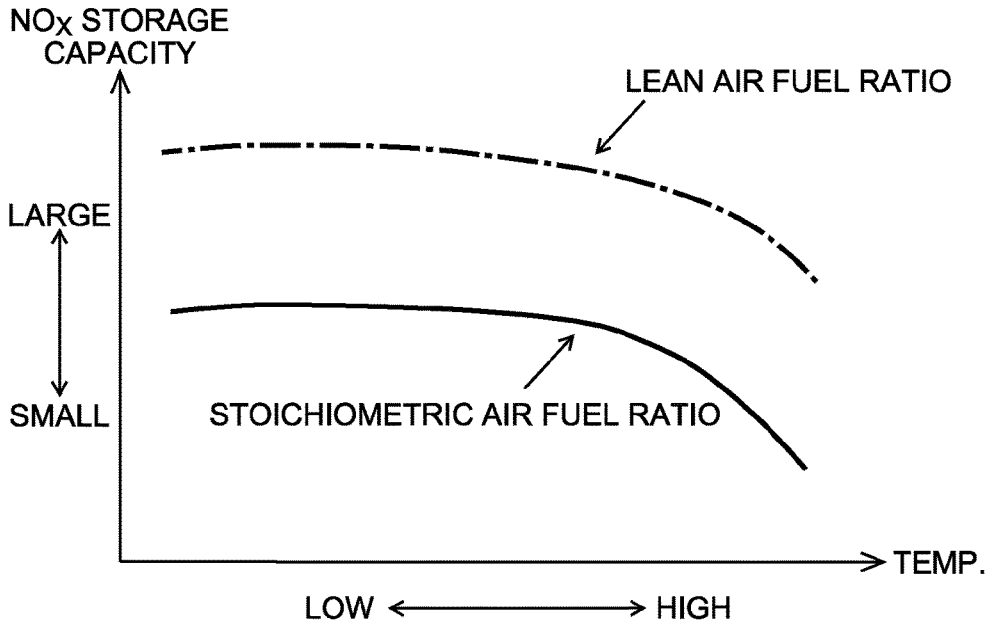
FIG. 4 is a view showing the correlation among the temperature of an NSR catalyst, the air fuel ratio of exhaust gas flowing into the second catalyst casing, and the $NO_x$ storage capacity of the NSR catalyst.

However, the $NO_x$ storage capacity of the NSR catalyst changes not only with the air fuel ratio of exhaust gas flowing into the second catalyst casing 5 but with the temperature of the NSR catalyst. For example, as shown in FIG. 4, the $NO_x$ storage capacity of the NSR catalyst becomes smaller in the case where the air fuel ratio of the exhaust gas flowing into the second catalyst casing 5 is the stoichiometric air fuel ratio than in the case where it is a lean air fuel ratio, and also becomes smaller in the case where the temperature of the NSR catalyst is high than in the case where it is low. When the predetermined $NO_x$ amount is set without taking into consideration such a characteristic of the NSR catalyst, rich spike processing may be carried out at the time of shifting the air fuel ratio of the air-fuel mixture from the lean air fuel ratio to the stoichiometric air fuel ratio, in spite of the fact that the storage amount of $NO_x$ in the NSR catalyst (the storage amount of $NO_x$ when the air fuel ratio of the exhaust gas is the stoichiometric air fuel ratio) has a sufficient margin, so that the amount of fuel consumption of the internal combustion engine may be accordingly increased.

Accordingly, in this embodiment, based on the characteristic shown in the above-mentioned FIG. 4, the predetermined $NO_x$ amount is set in consideration of the temperature of the NSR catalyst at the time of shifting the air fuel ratio of the air-fuel mixture from the lean air fuel ratio to the stoichiometric air fuel ratio. Specifically, the ECU 6 estimates the $NO_x$ storage capacity of the NSR catalyst after the air fuel ratio of the air-fuel mixture has been shifted from the lean air fuel ratio to the stoichiometric air fuel ratio, and sets the $NO_x$ storage capacity thus estimated as the predetermined $NO_x$ amount. The "$NO_x$ storage capacity" referred to herein is a maximum value of the amount of $NO_x$ which can be stored by the NSR catalyst, in other words, a storage amount of $NO_x$ at the time when the $NO_x$ storage ability of the NSR catalyst is saturated. In estimating such a $NO_x$ storage capacity, it is assumed that the above-mentioned correlation as shown in FIG. 4 has been stored in the ROM of the ECU 6 in the form of a map or a functional expression. Then, the ECU 6 calculates the NO storage capacity of the NSR catalyst after the air fuel ratio of the air-fuel mixture has been shifted from the lean air fuel ratio to the stoichiometric air fuel ratio, by accessing the map or the functional expression by using as an argument the temperature of the NSR catalyst at the time of shifting the air fuel ratio of the air-fuel mixture from the lean air fuel ratio to the stoichiometric air fuel ratio. Thus, an "estimation unit" according to the present disclosure is achieved by obtaining the $NO_x$ storage capacity by the ECU 6. Subsequently, the ECU 6 sets the $NO_x$ storage capacity as the predetermined $NO_x$ amount. Here, note that, when taking the point of view of decreasing the amount of $NO_x$ discharged from the NSR catalyst as much as possible, there may be set, as the predetermined $NO_x$ amount, an amount which is obtained by subtracting a predetermined margin from the $NO_x$ storage capacity estimated based on the temperature of the NSR catalyst.

Figure 5:
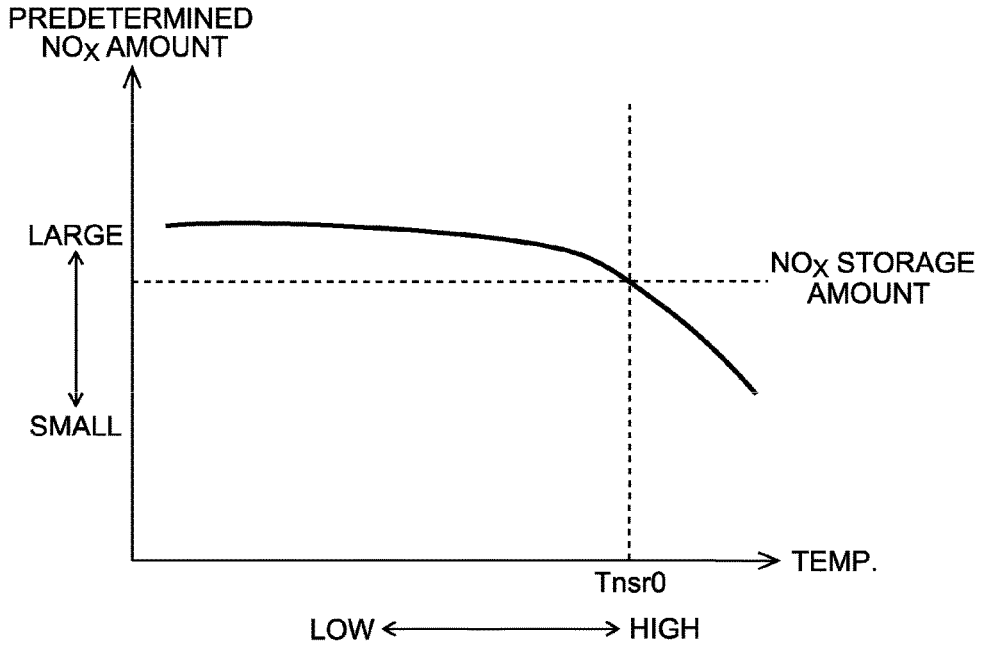
FIG. 5 is a view showing the correlation between the temperature of the NSR catalyst and a predetermined $NO_x$ amount.

The predetermined $NO_x$ amount set by the above-mentioned method becomes a larger value in the case where the temperature of the NSR catalyst is low than in the case where it is high, as shown in FIG. 5. For that reason, when the temperature of the NSR catalyst at the time when the air fuel ratio of the air-fuel mixture is shifted from the lean air fuel ratio to the stoichiometric air fuel ratio is higher than Tnsr0 in FIG. 5 (i.e., a temperature at the time when the predetermined $NO_x$ amount becomes equal to the storage amount of $NO_x$ in the NSR catalyst, the predetermined $NO_x$ amount becomes smaller than the storage amount of $NO_x$ in the NSR catalyst. On the other hand, when the temperature of the NSR catalyst at the time of the air fuel ratio of the air-fuel mixture being shifted from the lean air fuel ratio to the stoichiometric air fuel ratio is equal to or lower than Tnsr0 in FIG. 5, the predetermined $NO_x$ amount becomes equal to or more than the storage amount of $NO_x$ in the NSR catalyst. As a result, when the temperature of the NSR catalyst at the time of the air fuel ratio of the air-fuel mixture being shifted from the lean air fuel ratio to the stoichiometric air fuel ratio is higher than Tnsr0 in FIG. 5, rich spike processing will be carried out, but when the temperature of the NSR catalyst at the time of the air fuel ratio of the air-fuel mixture being shifted from the lean air fuel ratio to the stoichiometric air fuel ratio is equal to or lower than Tnsr0 in FIG. 5, rich spike processing will not be carried out. In other words, in the case where the temperature of the NSR catalyst at the time of the air fuel ratio of the air-fuel mixture being shifted from the lean air fuel ratio to the stoichiometric air fuel ratio is high, rich spike processing will be carried out in a state where the storage amount of $NO_x$ in the NSR catalyst is smaller, in comparison with the case where the temperature of the NSR catalyst is low. Accordingly, when the air fuel ratio of the air-fuel mixture is shifted from the lean air fuel ratio to the stoichiometric air fuel ratio, the amount of $NO_x$ discharged from the NSR catalyst after the air fuel ratio of the air-fuel mixture has been shifted from the lean air fuel ratio to the stoichiometric air fuel ratio can be suppressed to a small level, while suppressing unnecessary execution of the rich spike processing.

Figure 6:
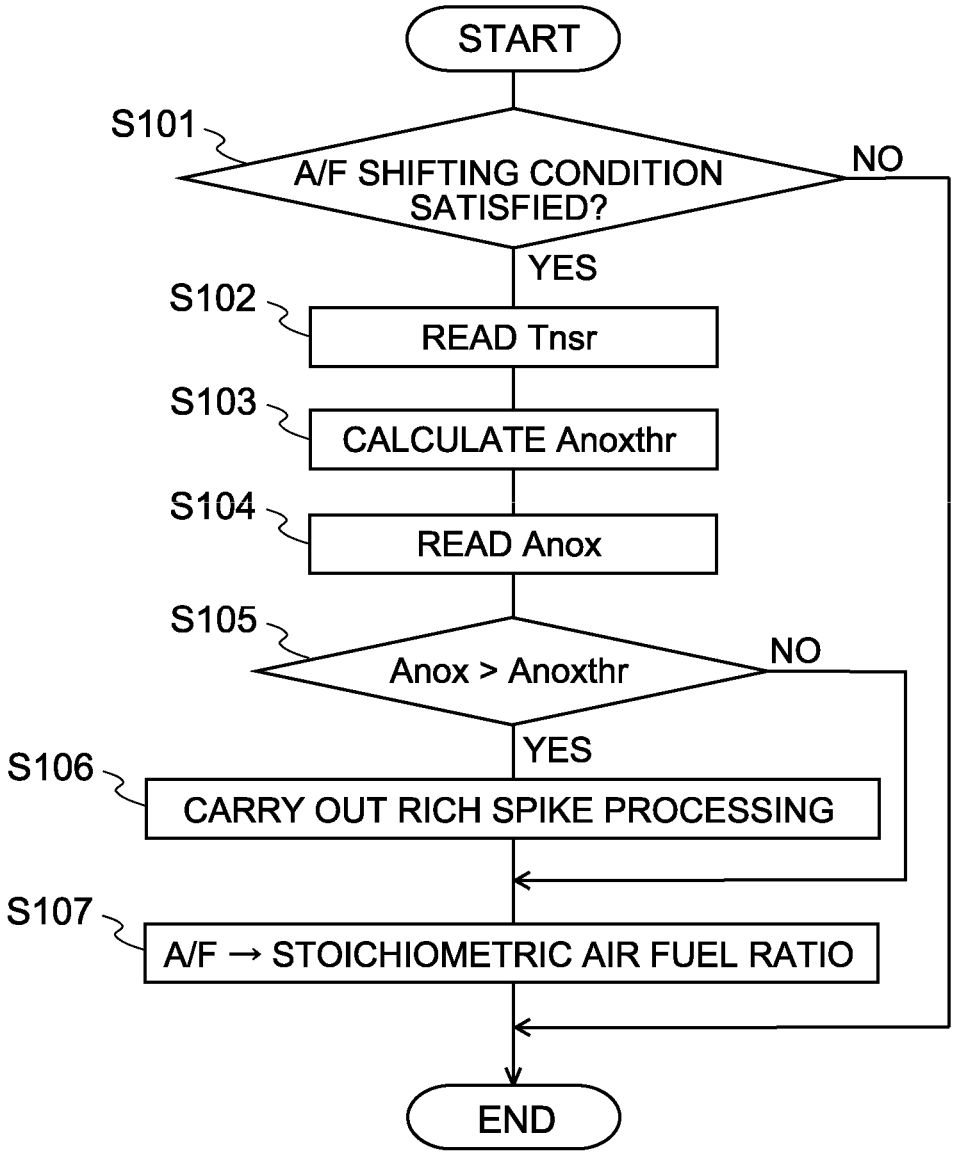
FIG. 6 is a flow chart showing a processing routine which is executed by an ECU at the time when the operating condition of the internal combustion engine is shifted from a lean operating region to a stoichiometric operating region, in the first embodiment of the present disclosure.

In the following, reference will be made to an execution procedure for the rich spike processing at the time when the air fuel ratio of the air-fuel mixture is shifted from the lean air fuel ratio to the stoichiometric air fuel ratio, in line with FIG. 6. FIG. 6 is a flow chart showing a processing routine which is executed by the ECU 6 at the time when the operating condition of the internal combustion engine 1 is shifted from the lean operating region to the stoichiometric operating region, in the first embodiment of the present disclosure. This processing routine has been beforehand stored in the ROM of the ECU 6, and is carried out in a periodical manner by the ECU 6 when the operating condition of the internal combustion engine 1 belongs to the lean operating region (i.e., the air fuel ratio of the air-fuel mixture has been set to the lean air fuel ratio).

In the processing routine of FIG. 6, first in the processing of step S101, the ECU 6 determines whether an execution condition for shifting the air fuel ratio (A/F) of the air-fuel mixture from the lean air fuel ratio to the stoichiometric air fuel ratio (i.e., an A/F shifting condition) is satisfied. Specifically, when the operating condition of the internal combustion engine 1 is shifted from the lean operating region to the stoichiometric operating region, the ECU 6 makes a determination that the A/F shifting condition has been satisfied. That is, when the last operating condition is in the lean operating region, and when the current operating condition is in the stoichiometric operating region, a determination is made that the A/F shifting condition has been satisfied. Here, note that, not only at the time of the shifting of the actual operating condition, but also at the time when a targeted operating condition of the internal combustion engine 1 is shifted from the lean operating region to the stoichiometric operating region, for example, a determination may be made that the A/F shifting condition has been satisfied. In cases where a negative determination is made in the processing of step S101, the ECU 6 ends the execution of this processing routine. On the other hand, in cases where an affirmative determination is made in the processing of step S101, the routine of the ECU 6 goes to the processing of step S102.

In the processing of step S102, the ECU 6 reads in the temperature Tnsr of the NSR catalyst. The temperature Tnsr of the NSR catalyst may be calculated based on the measured value of the exhaust gas temperature sensor 10 (i.e., the temperature of the exhaust gas) and the flow rate of the exhaust gas (i.e., the total amount of the measured value of the air flow meter 13 (the amount of intake air) and the amount of fuel injection). Here, note that the measured value of the exhaust gas temperature sensor 10 may be substituted as the temperature Tnsr of the NSR catalyst. In this manner, by carrying out the processing of step S102 by the ECU 6, a "first detection unit" according to the present disclosure is achieved.

In the processing of step S103, the ECU 6 calculates the above-mentioned predetermined $NO_x$ amount ANOXthr. Specifically, the ECU 6 calculates the $NO_x$ storage capacity of the NSR catalyst after the air fuel ratio of the air-fuel mixture has been shifted from the lean air fuel ratio to the stoichiometric air fuel ratio, by accessing the map or the functional expression in which the above-mentioned correlation shown in FIG. 4 has been stored, by using as an argument the temperature Tnsr of the NSR catalyst read in the above-mentioned processing of step S102. Subsequently, the ECU 6 sets the $NO_x$ storage capacity thus obtained as the predetermined $NO_x$ amount Anoxthr. Here, note that the predetermined $NO_x$ amount Anoxthr may be set to the amount which is obtained by subtracting the predetermined margin from the $NO_x$ storage capacity, as referred to above. In addition, the above-mentioned correlation as shown in FIG. 5 may have been stored in the ROM of the ECU 6 in the form of a map or a functional expression in advance, so that the predetermined $NO_x$ amount Anoxthr may be calculated by using the temperature Tnsr of the NSR catalyst as an argument. The routine of the ECU 6 goes to the processing of step S104, after the processing of step S103 has been carried out.

In the processing of step S104, the ECU 6 reads in the storage amount of $NO_x$ Anox in the NSR catalyst. Here, it is assumed that the storage amount of $NO_x$ Anox in the NSR catalyst has been calculated by the method of integrating the amount of $NO_x$ flowing into the second catalyst casing 5 per unit time from the point in time at which the last rich spike processing has ended, and has then been stored in the backup RAM of the ECU 6, etc. In this manner, by carrying out the processing of step S104 by the ECU 6, a "second detection unit" according to the present disclosure is achieved. The routine of the ECU 6 goes to the processing of step S105, after the processing of step S104 has been carried out.

In the processing of step S105, the ECU 6 determines whether the storage amount of $NO_x$ Anox read in the above-mentioned processing of step S104 is more than the predetermined $NO_x$ amount Anoxthr which has been calculated in the above-mentioned processing of step S103. In cases where an affirmative determination is made in the processing of step S105 (Anox>Anoxthr), the $NO_x$ storage capacity after the air fuel ratio of the air-fuel mixture has been shifted from the lean air fuel ratio to the stoichiometric air fuel ratio may become smaller than the storage amount of $NO_x$ Anox, and accordingly, it can be considered that $NO_x$ may be discharged from the NSR catalyst. Accordingly, in cases where an affirmative determination is made in the processing of step S105, the routine of the ECU 6 goes to the processing of step S106, and carries out rich spike processing. The execution period of time of the rich spike processing in that case may be a period of time required for reducing an amount of $NO_x$ (e.g., a difference between the storage amount of $NO_x$ Anox and the predetermined $NO_x$ amount Anoxthr) which is expected to be discharged from the NSR catalyst, or may be a period of time required for reducing all the $NO_x$ stored in the NSR catalyst. In this manner, by carrying out the processing of step S106 by the ECU 6, a "rich spike unit" according to the present disclosure is achieved. After completing the execution of the rich spike processing, the routine of the ECU 6 goes to the processing of step S107, where the air fuel ratio (A/F) of the air-fuel mixture is controlled to the stoichiometric air fuel ratio, without being returned to the lean air fuel ratio. When the air fuel ratio (A/F) of the air-fuel mixture is shifted from the lean air fuel ratio to the stoichiometric air fuel ratio according to such a procedure, the amount of $NO_x$ discharged from the NSR catalyst after the shifting of the air fuel ratio of the air-fuel mixture can be suppressed to be small, as described in the above-mentioned explanation of FIG. 3.

On the other hand, in cases where a negative determination is made in the above-mentioned processing of step S105 (Anox≤Anoxthr), it can be assumed that the $NO_x$ storage capacity after the air fuel ratio (A/F) of the air-fuel mixture has been shifted from the lean air fuel ratio to the stoichiometric air fuel ratio is equal to or more than the storage amount of $NO_x$ Anox. For that reason, even if the rich spike processing is not carried out in the process in which the air fuel ratio (A/F) of the air-fuel mixture is shifted from the lean air fuel ratio to the stoichiometric air fuel ratio, the amount of $NO_x$ discharged from the NSR catalyst after the shifting of the air fuel ratio of the air-fuel mixture becomes small. Accordingly, in cases where an affirmative determination is made in the processing of step S105, the ECU 6 carries out the processing of step S107, skipping the processing of step S106. When the air fuel ratio (A/F) of the air-fuel mixture is shifted from the lean air fuel ratio to the stoichiometric air fuel ratio according to such a procedure, it is possible to suppress unnecessary execution of the rich spike processing, without increasing the amount of $NO_x$ discharged from the NSR catalyst after the shifting of the air fuel ratio of the air-fuel mixture.

As described above, a "control unit" according to the present disclosure is achieved by the ECU 6 carrying out the processing routine of FIG. 6. Accordingly, at the time of shifting the air fuel ratio of the air-fuel mixture from the lean air fuel ratio to the stoichiometric air fuel ratio, the amount of $NO_x$ discharged from the NSR catalyst after the shifting of the air fuel ratio of the air-fuel mixture can be suppressed to a small level, while suppressing unnecessary execution of the rich spike processing. As a result, it is possible to suppress the deterioration of exhaust emissions, while suppressing an increase in the amount of fuel consumption resulting from the unnecessary execution of the rich spike processing. In addition, when the ECU 6 carries out the processing routine of FIG. 6, it is also possible to decrease the opportunity for the rich spike processing to be carried out at the time when the air fuel ratio of the air-fuel mixture is shifted from the lean air fuel ratio to the stoichiometric air fuel ratio in a state where the temperature of the NSR catalyst is relatively low. For that reason, it is also possible to suppress the deterioration of exhaust emissions resulting from the rich spike processing being carried out in the state where the temperature of the NSR catalyst is relatively low.

Here, note that in this embodiment, there has been described an example in which at the time of obtaining the $NO_x$ storage capacity of the NSR catalyst after the air fuel ratio of the air-fuel mixture has been shifted from the lean air fuel ratio to the stoichiometric air fuel ratio, the temperature of the NSR catalyst is used as a parameter, but in addition to the temperature of the NSR catalyst, there can also be used, as a parameter, the concentration of $NO_x$ in the exhaust gas flowing into the second catalyst casing 5 after the air fuel ratio of the air-fuel mixture has been shifted from the lean air fuel ratio to the stoichiometric air fuel ratio. At that time, in the case where the concentration of $NO_x$ in the exhaust gas flowing into the second catalyst casing 5 is low after the air fuel ratio of the air-fuel mixture has been shifted from the lean air fuel ratio to the stoichiometric air fuel ratio, it is only necessary to make the $NO_x$ storage capacity of the NSR catalyst smaller, in comparison with the case where the concentration of $NO_x$ is high. Also, note that after the air fuel ratio of the air-fuel mixture has been shifted from the lean air fuel ratio to the stoichiometric air fuel ratio, most of the $NO_x$ discharged from the internal combustion engine 1 is reduced by the three-way catalyst of the first catalyst casing 4. For that reason, the concentration of $NO_x$ in the exhaust gas flowing into the second catalyst casing 5 after the air fuel ratio of the air-fuel mixture has been shifted from the lean air fuel ratio to the stoichiometric air fuel ratio may also be assumed to be zero or a value approximate to zero. In addition, in an arrangement in which the first catalyst casing 4 is not disposed in the exhaust pipe 3 at a location upstream of the second catalyst casing 5, it is only necessary to calculate (estimate) the concentration of $NO_x$ in the exhaust gas flowing into the second catalyst casing 5 after the air fuel ratio of the air-fuel mixture has been shifted from the lean air fuel ratio to the stoichiometric air fuel ratio by using, as a parameter, the operating condition (the engine load, the engine rotation speed, etc.) of the internal combustion engine 1. When the $NO_x$ storage capacity is obtained by taking into consideration the concentration of $NO_x$ in the exhaust gas flowing into the second catalyst casing 5 after the air fuel ratio of the air-fuel mixture has been shifted from the lean air fuel ratio to the stoichiometric air fuel ratio, in addition to the temperature of the NSR catalyst, it is possible to obtain the $NO_x$ storage capacity of the NSR catalyst after the air fuel ratio of the air-fuel mixture has been shifted from the lean air fuel ratio to the stoichiometric air fuel ratio in a more precise manner.

In addition, in this embodiment, there has been described an example in which when the storage amount of $NO_x$ in the NSR catalyst is more than the predetermined $NO_x$ amount, at the time of the air fuel ratio of the air-fuel mixture being shifted from the lean air fuel ratio to the stoichiometric air fuel ratio, rich spike processing is carried out, but when the temperature of the NSR catalyst is higher than the predetermined temperature, rich spike processing may be carried out. The "predetermined temperature" referred to herein corresponds to Tnsr0 (i.e., a temperature at which the predetermined $NO_x$ amount becomes equal to the storage amount of $NO_x$) shown in the above-mentioned FIG. 5. According to such a method, there can be obtained the same effects as in this embodiment.

Second Embodiment

Figure 7:
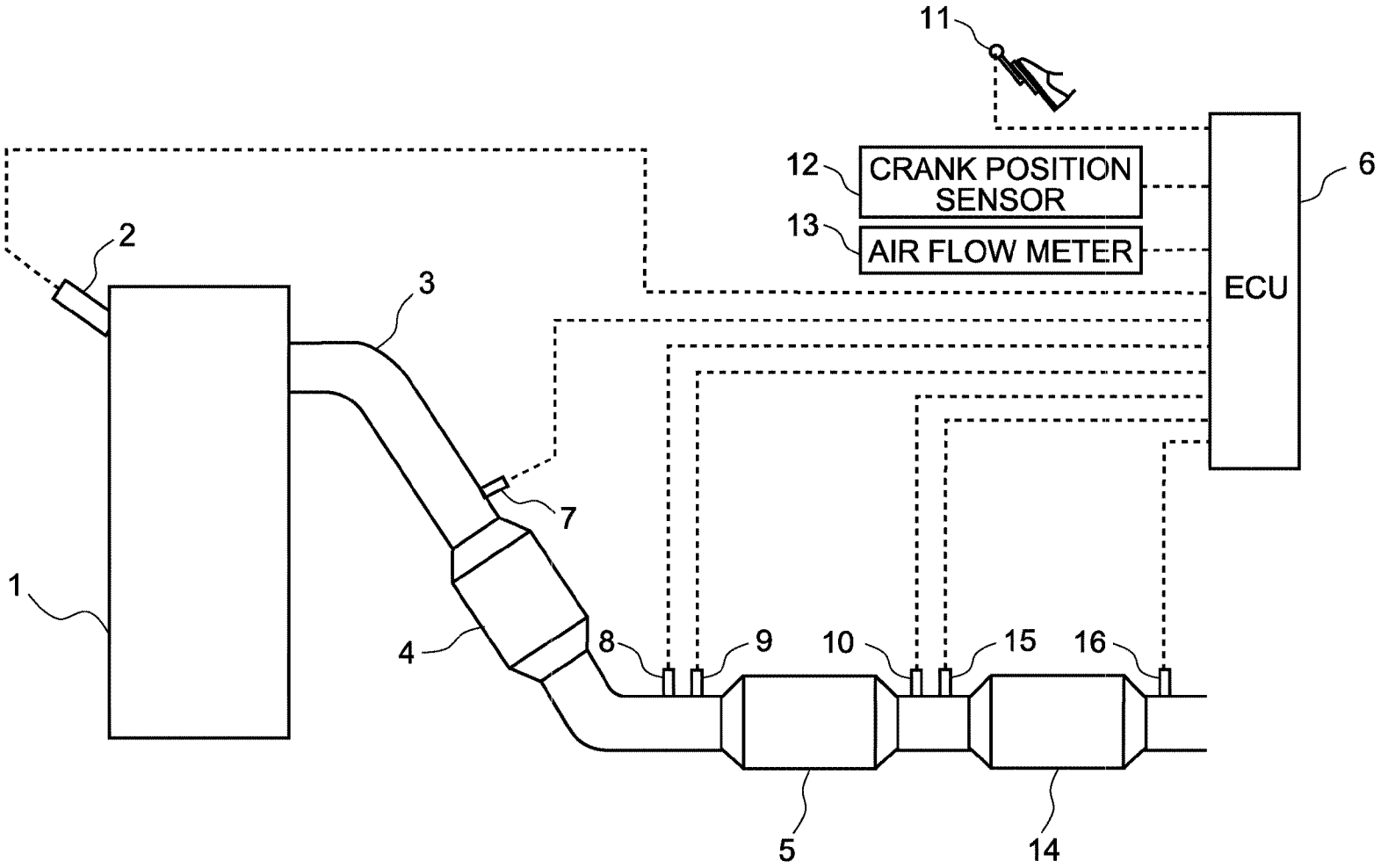
FIG. 7 is a view showing the schematic construction of an exhaust system of an internal combustion engine to which the present disclosure is applied, in a second embodiment of the present disclosure.

Next, reference will be made to a second embodiment of the present disclosure based on FIGS. 7 and 8. Here, a construction different from that of the above-mentioned first embodiment will be described, and an explanation of the same construction will be omitted. A difference between this second embodiment and the above-mentioned first embodiment is that a third catalyst casing 14 is arranged in the exhaust pipe 3 at the downstream side of the second catalyst casing 5.

The third catalyst casing 14 receives an SCR catalyst. Specifically, the third catalyst casing 14 receives a honeycomb structured body made of cordierite or Fe—Cr—Al based heat resisting steel, a zeolite based coat layer covering the honeycomb structured body, and a transition metal (copper (Cu), iron (Fe), etc.) supported by the coat layer. The combination of this third catalyst casing 14 and the second catalyst casing 5 corresponds to an "exhaust gas purification device" according to the present disclosure.

In addition, a $NO_x$ sensor 15, in addition to the above-mentioned exhaust gas temperature sensor 10, is arranged in the exhaust pipe 3 at a location between the second catalyst casing 5 and the third catalyst casing 14. Further, a $NO_x$ sensor 16 is arranged in the exhaust pipe 3 at the downstream side of the third catalyst casing 14. Hereinafter, the $NO_x$ sensor 9 arranged in the exhaust pipe 3 at a location between the first catalyst casing 4 and the second catalyst casing 5 is referred to as a "first $NO_x$ sensor 9". Moreover, the $NO_x$ sensor 15 arranged in the exhaust pipe 3 at a location between the second catalyst casing 5 and the third catalyst casing 14 is referred to as a "second $NO_x$ sensor 15". Further, the $NO_x$ sensor 16 arranged in the exhaust pipe 3 at the downstream side of the third catalyst casing 14 is referred to as a "third $NO_x$ sensor 16".

In the arrangement as mentioned above, the $NO_x$ discharged from the NSR catalyst after the air fuel ratio of the air-fuel mixture has been shifted from the lean air fuel ratio to the stoichiometric air fuel ratio may be reduced by the SCR catalyst in the third catalyst casing 14. Specifically, in cases where the storage amount of $NO_x$ in the NSR catalyst at the time of the air fuel ratio of the air-fuel mixture being shifted from the lean air fuel ratio to the stoichiometric air fuel ratio is more than the above-mentioned predetermined $NO_x$ amount, the $NO_x$ discharged from the NSR catalyst is reduced and removed by the SCR catalyst, when an amount of $NO_x$ ($NO_x$ reducible amount) which can be reduced by an amount of $NH_3$ adsorbed to the SCR catalyst is larger, in comparison with the difference between the storage amount of $NO_x$ and the predetermined $NO_x$ amount (i.e., this difference being an amount of $NO_x$ which is considered to be discharged from the NSR catalyst after the air fuel ratio of the air-fuel mixture has been shifted from the lean air fuel ratio to the stoichiometric air fuel ratio, and being referred to as an "estimated amount of discharge"), or when the difference and the $NO_x$ reducible amount are equal to each other. Accordingly, in this second embodiment, even in cases where the storage amount of $NO_x$ in the NSR catalyst at the time of the air fuel ratio of the air-fuel mixture being shifted from the lean air fuel ratio to the stoichiometric air fuel ratio is more than the predetermined $NO_x$ amount, rich spike processing is not carried out, when the $NO_x$ reducible amount is equal to or more than the estimated amount of discharge.

In the following, reference will be made to an execution procedure for the rich spike processing at the time when the air fuel ratio of the air-fuel mixture is shifted from the lean air fuel ratio to the stoichiometric air fuel ratio, in line with FIG. 8. FIG. 8 is a flowchart showing a processing routine which is executed by the ECU 6 at the time when the operating condition of the internal combustion engine 1 is shifted from the lean operating region to the stoichiometric operating region, in the first embodiment of the present disclosure. In the processing routine of FIG. 8, the same or like symbols are attached to the like processings as those in the above-mentioned processing routine of FIG. 6.

Figure 8:
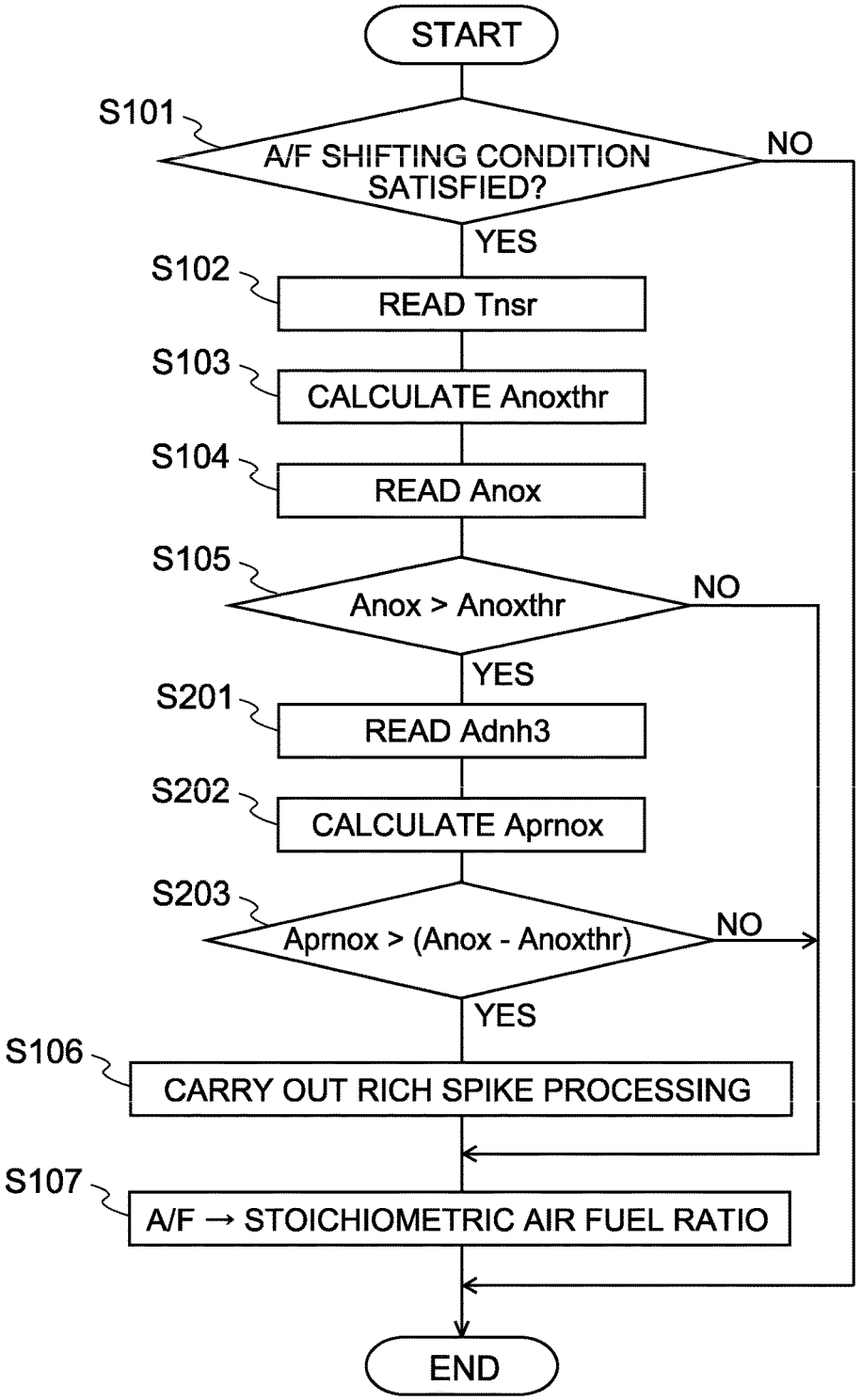
FIG. 8 is a flow chart showing a processing routine which is executed by an ECU at the time when the operating condition of the internal combustion engine is shifted from a lean operating region to a stoichiometric operating region, in the second embodiment of the present disclosure.

The difference between the processing routine of FIG. 8 and the above-mentioned processing routine of FIG. 6 is that in cases where an affirmative determination is made in the processing of step S105, i.e., in cases where the storage amount of $NO_x$ Anox in the NSR catalyst is more than the predetermined $NO_x$ amount Anoxthr), the processings of steps S201 through S203 are carried out. In the processing of step S201, the ECU 6 reads in an amount of $NH_3$ (an amount of $NH_3$ adsorption) Adnh3 adsorbed to the SCR catalyst in the third catalyst casing 14. The amount of $NH_3$ adsorption Adnh3 in the SCR catalyst is calculated by integrating a value which is obtained by subtracting an amount of $NH_3$ consumption (an amount of $NH_3$ which contributes to the reduction of $NO_x$) and an amount of $NH_3$ slip (an amount of $NH_3$ which slips or passes through the SCR catalyst), from an amount of $NH_3$ to be supplied to the third catalyst casing 14. In this manner, by calculating the amount of $NH_3$ adsorption Adnh3 in the SCR catalyst by the ECU 6, a "third detection unit" according to the present disclosure is achieved.

Here, note that the amount of $NH_3$ to be supplied to the SCR catalyst is a total amount of an amount of $NH_3$ to be produced in the three-way catalyst of the first catalyst casing 4 and an amount of $NH_3$ to be produced in the NSR catalyst of the second catalyst casing 5. The amount of $NH_3$ to be produced in the three-way catalyst is correlated with the air fuel ratio of the exhaust gas, the flow rate of the exhaust gas, and the temperature of the three-way catalyst. For that reason, when the correlation has been obtained in advance, the amount of $NH_3$ to be produced in the three-way catalyst can be obtained by using as arguments the air fuel ratio of the exhaust gas, the flow rate of the exhaust gas, and the temperature of the three-way catalyst. On the other hand, the amount of $NH_3$ to be produced in the NSR catalyst is correlated with the air fuel ratio of the exhaust gas, the flow rate of the exhaust gas, and the temperature of the NSR catalyst. For that reason, when this correlation has been obtained in advance, the amount of $NH_3$ to be produced in the NSR catalyst can be obtained by using as arguments the air fuel ratio of the exhaust gas, the flow rate of the exhaust gas, and the temperature of the NSR catalyst.

The amount of $NH_3$ consumption is calculated by using as parameters the amount of $NO_x$ flowing into the SCR catalyst (the amount of inflowing $NO_x$) and the $NO_x$ reduction rate of the SCR catalyst. The amount of inflowing $NO_x$ in that case is calculated by multiplying the measured value of the second $NO_x$ sensor 15 (the concentration of $NO_x$ in the exhaust gas flowing into the third catalyst casing 14) and the flow rate of the exhaust gas. On the other hand, the rate of $NO_x$ reduction used for the calculation of the amount of $NH_3$ consumption is calculated by using as parameters the flow rate of the exhaust gas and the temperature of the SCR catalyst. At that time, the correlation among the flow rate of the exhaust gas, the temperature of the SCR catalyst, and the $NO_x$ reduction rate of the SCR catalyst has been obtained experimentally in advance.

The amount of $NH_3$ slip is obtained by using as parameters the last calculated value of the amount of $NH_3$ adsorption, the temperature of the SCR catalyst, and the flow rate of the exhaust gas. Here, when the flow rate of the exhaust gas is constant, the concentration of $NH_3$ in the exhaust gas flowing out from the SCR catalyst becomes higher in accordance with the increasing amount of $NH_3$ adsorption and/or the higher (rising) temperature of the SCR catalyst. In addition, when the concentration of $NH_3$ in the exhaust gas flowing out from the SCR catalyst is constant, the amount of $NH_3$ slip per unit time increases in accordance with the increasing flow rate of the exhaust gas. Based on these correlations, the amount of $NH_3$ slip can be obtained by calculating the concentration of $NH_3$ in the exhaust gas flowing out from the SCR catalyst, using as parameters the amount of $NH_3$ adsorption in the SCR catalyst and the temperature of the SCR catalyst, and subsequently by multiplying the flow rate of the exhaust gas to the concentration of $NH_3$.

Here, returning to the processing routine of FIG. 8, the ECU 6 goes to the processing of step S202 after having carried out the above-mentioned processing of step S201. In the processing of step S202, the ECU 6 calculates a $NO_x$ reducible amount Aprnox of the SCR catalyst. Because the $NO_x$ reducible amount Aprnox of the SCR catalyst is correlated with the amount of $NH_3$ adsorption in the SCR catalyst and the $NO_x$ reduction rate of the SCR catalyst, this correlation has been obtained experimentally in advance. Here, note that the rate of $NO_x$ reduction used for the calculation of the $NO_x$ reducible amount Aprnox is calculated by the same or like method as that used in the rate of $NO_x$ reduction for use with the above-mentioned calculation of the amount of $NH_3$ consumption. When having carried out the processing of step S202, the routine of the ECU 6 goes to the processing of step S203.

In the processing of step S203, the ECU 6 calculates the above-mentioned estimated amount of discharge (=(Anox−

Anoxthr)) by subtracting the predetermined $NO_x$ amount Anoxthr from the storage amount of $NO_x$ ANOX. Then, the ECU 6 determines whether the $NO_x$ reducible amount Aprnox calculated in the above-mentioned processing of step S202 is smaller than the estimated amount of discharge. In cases where an affirmative determination is made in the processing of step S203, it can be assumed that the entire amount of $NO_x$ discharged from the NSR catalyst after the air fuel ratio (A/F) of the air-fuel mixture has been shifted from the lean air fuel ratio to the stoichiometric air fuel ratio is not reduced by the SCR catalyst. For that reason, in cases where an affirmative determination is made in the processing of step S203, the routine of the ECU 6 goes to the processing of step S106, where rich spike processing is carried out. On the other hand, in cases where a negative determination is made in the processing of step S203, it can be assumed that the entire amount of $NO_x$ discharged from the NSR catalyst after the air fuel ratio (A/F) of the air-fuel mixture has been shifted from the lean air fuel ratio to the stoichiometric air fuel ratio is reduced by the SCR catalyst. For that reason, in cases where a negative determination is made in the processing of step S203, the routine of the ECU 6 goes to the processing of step S107, while skipping the processing of step S106.

As described above, when the ECU 6 carries out the processing routine of FIG. 8, even in cases where the storage amount of $NO_x$ in the NSR catalyst at the time of the air fuel ratio of the air-fuel mixture being shifted from the lean air fuel ratio to the stoichiometric air fuel ratio is larger than the predetermined $NO_x$ amount, rich spike processing is not carried out, when the $NO_x$ reducible amount is equal to or more than the estimated amount of discharge. As a result, it is possible to make smaller the opportunity for the rich spike processing not to be carried out at the time when the air fuel ratio of the air-fuel mixture is shifted from the lean air fuel ratio to the stoichiometric air fuel ratio. Accordingly, an increase in the amount of fuel consumption resulting from the unnecessary execution of the rich spike processing can be suppressed to be smaller.

Here, note that in this second embodiment, the above-mentioned predetermined $NO_x$ amount is set based on the $NO_x$ storage capacity of the NSR catalyst after the air fuel ratio of the air-fuel mixture has been shifted from the lean air fuel ratio to the stoichiometric air fuel ratio, but the predetermined $NO_x$ amount may be set based on the $NO_x$ storage capacity of the NSR catalyst and the $NO_x$ reducible amount of the SCR catalyst after the air fuel ratio of the air-fuel mixture has been shifted from the lean air fuel ratio to the stoichiometric air fuel ratio. That is, a total amount of the $NO_x$ storage capacity and the $NO_x$ reducible amount (or an amount which is obtained by subtracting a margin from the total amount) may be set as the predetermined $NO_x$ amount. The predetermined $NO_x$ amount in that case becomes smaller in the case where the temperature of the NSR catalyst at the time of the shifting of the air fuel ratio of the air-fuel mixture from the lean air fuel ratio to the stoichiometric air fuel ratio is high, than in the case where it is low, and also becomes smaller in the case where the amount of $NH_3$ adsorption in the SCR catalyst is small than in the case where it is large. Thus, in the case of using the predetermined $NO_x$ amount set in this manner, it is only necessary to carry out the rich spike processing according to the same procedure as shown in the above-mentioned processing routine of FIG. 6. As a result, in the case where the temperature of the NSR catalyst is high and the amount of $NH_3$ adsorption in the SCR catalyst is small, rich spike processing will be carried out in a state where the storage amount of $NO_x$ in the NSR catalyst is smaller, in comparison with the case where the temperature of the NSR catalyst is low and the amount of $NH_3$ adsorption in the SCR catalyst is small. Accordingly, there can be obtained the same effects as in the case where the rich spike processing is carried out according to the procedure shown in the processing routine of FIG. 8.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

REFERENCE SIGNS LIST

1 internal combustion engine
2 fuel injection valves
3 exhaust pipe
4 first catalyst casing
5 second catalyst casing
6 ECU
7 air fuel ratio sensor
8 oxygen concentration sensor
9 $NO_x$ sensor (first $NO_x$ sensor)
10 exhaust gas temperature sensor
11 accelerator position sensor
14 third catalyst casing

The invention claimed is:

1. A control apparatus comprising:

an internal combustion engine the internal combustion engine having a plurality of cylinders;

an exhaust gas purification device which is arranged in an exhaust passage, the exhaust gas purification device including a $NO_x$ storage reduction catalyst and a selective catalytic reduction catalyst which is arranged at a downstream side of the $NO_x$ storage reduction catalyst;

a plurality of fuel injection valves that supply fuel to the plurality of cylinders of the internal combustion engine;

a temperature sensor that detects a temperature of the $NO_x$ storage reduction catalyst;

a $NO_x$ sensor that detects a concentration of $NO_x$ that flows into the $NO_x$ storage reduction catalyst;

an electronic control unit operatively connected to the plurality of fuel injection valves, the temperature sensor and the $NO_x$ sensor, the electronic control unit configured to:

calculate a $NO_x$ storage amount which is an amount of $NO_x$ stored in the $NO_x$ storage reduction catalyst;

calculate an amount of $NH_3$ adsorption which is an amount of $NH_3$ adsorbed to the selective catalytic reduction catalyst;

carry out rich spike processing which is to reduce $NO_x$ stored in the NSR catalyst by controlling the plurality of fuel injection valves to adjust an air fuel ratio of exhaust gas flowing into the exhaust gas purification device to a rich air fuel ratio;

carry out the rich spike processing, when the air fuel ratio of the air-fuel mixture is shifted from a lean air fuel ratio to the stoichiometric air fuel ratio, such that the rich spike processing is carried out in a state in which the $NO_x$ storage amount is smaller when the temperature of the $NO_x$ storage reduction catalyst is high in comparison with when the temperature of the $NO_x$ storage reduction catalyst is low; and control the plurality of fuel injection valves to adjust the air fuel ratio of the air-fuel mixture to the stoichiometric air fuel ratio after the end of the rich spike processing;

wherein the electronic control unit is configured, when the air fuel ration of the air-fuel ratio mixture is shifted from the lean air fuel ratio to the stoichiometric air fuel ratio, to carry out the rich spike processing when the $NO_x$ storage amount is larger than a predetermined $NO_x$ amount and a difference between the $NO_x$ storage amount and the predetermined $NO_x$ amount is more than an amount of $NO_x$ which can be reduced by the amount of $NH_3$ adsorption calculated by the electronic control unit, and wherein the electronic control unit is configured to change the predetermined $NO_x$ amount so as to be larger when the temperature of the $NO_x$ storage reduction catalyst is high in comparison with when the detected temperature of the $NO_x$ storage reduction catalyst is low.

2. The control apparatus as set forth in claim 1, wherein the electronic control unit is configured to estimate a $NO_x$ storage capacity which is an amount of $NO_x$ able to be stored by the $NO_x$ storage reduction catalyst after a shifting of the air fuel ratio of the air-fuel mixture from the lean air fuel ratio to the stoichiometric air fuel ratio, before the shifting, wherein the electronic control unit is configured to estimate the $NO_x$ storage capacity to be small when the temperature of the $NO_x$ storage reduction catalyst is high in comparison with when the temperature of the $NO_x$ storage reduction catalyst is low;

wherein the electronic control unit is configured, when the air fuel ratio of the air-fuel mixture is shifted from the lean air fuel ratio to the stoichiometric air fuel ratio, to carry out the rich spike processing when the $NO_x$ storage amount is larger than a predetermined $NO_x$ amount, and to change the predetermined $NO_x$ amount so as to be smaller when the $NO_x$ storage capacity estimated by the electronic control unit is low in comparison with when the $NO_x$ storage capacity is high.

3. The control apparatus as set forth in claim 2, wherein the electronic control unit is configured to predict a concentration of $NO_x$ in the exhaust gas flowing into the exhaust gas purification device after the shifting, the electronic control unit is configured to estimate the $NO_x$ storage capacity to be smaller when the $NO_x$ concentration is low in comparison with when the $NO_x$ concentration is high while estimating the $NO_x$ storage capacity to be smaller when the temperature of the $NO_x$ storage reduction catalyst is high in comparison with when the temperature of the $NO_x$ storage reduction catalyst is low.

* * * * *